US010443281B2

(12) United States Patent
Luedtke

(10) Patent No.: US 10,443,281 B2
(45) Date of Patent: Oct. 15, 2019

(54) DRESSER 2.0

(71) Applicant: Alexander Thomas Luedtke, Charlotte, NC (US)

(72) Inventor: Alexander Thomas Luedtke, Charlotte, NC (US)

( * ) Notice: Subject to any disclaimer, the term of this patent is extended or adjusted under 35 U.S.C. 154(b) by 0 days.

(21) Appl. No.: 15/802,091

(22) Filed: Nov. 2, 2017

(65) Prior Publication Data

US 2019/0128034 A1 May 2, 2019

(51) Int. Cl.
*E05D 15/00* (2006.01)
*A47B 61/00* (2006.01)

(52) U.S. Cl.
CPC ..... *E05D 15/00* (2013.01); *A47B 61/00* (2013.01); *E05Y 2900/212* (2013.01)

(58) Field of Classification Search
CPC ..... A47B 63/00; A47B 61/00; E05D 15/00; E05Y 2900/212; B01L 1/02; B01L 2300/046
USPC ..... 312/325, 139.1, 138.1, 110, 348.4, 323, 312/322, 109, 326–329, 292, 291, 351; 49/197, 201–204
See application file for complete search history.

(56) References Cited

U.S. PATENT DOCUMENTS 443,350 A * 12/1890 Berners
479,857 A * 8/1892 Tettelbach
755,615 A * 3/1904 Chatterton
1,529,601 A * 3/1925 Lyons ..... E06B 3/5045 49/197
1,725,867 A * 8/1929 Kennedy ..... A47F 3/12 312/139.1
1,729,401 A * 9/1929 Richards ..... A47B 47/04 312/109
1,980,116 A * 11/1934 Toborg ..... A47B 65/15 211/153
2,590,028 A * 3/1952 Miller ..... E05D 15/38 312/307
4,998,627 A * 3/1991 Elder ..... A47F 5/08 211/41.11
6,557,958 B1 * 5/2003 Motta ..... E05D 15/42 312/319.2
6,695,165 B2 * 2/2004 Park ..... E05D 15/38 220/810
6,705,687 B1 * 3/2004 McGraw ..... A47F 1/06 312/50
7,708,328 B2 * 5/2010 Doom ..... B60R 7/06 206/565
2006/0163981 A1 * 7/2006 Conrad ..... E06B 3/5045 312/323
2011/0120997 A1 * 5/2011 Most ..... B65F 1/163 220/263

FOREIGN PATENT DOCUMENTS

FR 2071766 * 9/1971
WO 2012141654 * 10/2012

OTHER PUBLICATIONS

DE 20203696 Kermax abs and figure (Year: 2002).*
CN 205106887; Wang X; Mar. 30, 2016 (Year: 2016).*

* cited by examiner

*Primary Examiner* — Janet M Wilkens

(57) ABSTRACT

A storage compartment with a front door that slides and rotates up and into the storage compartment with a structural divider between the side panels of the storage compartment that supports the shelves and door between the load bearing points at the side panels.

1 Claim, 6 Drawing Sheets

DRESSER 2.0

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

SEQUENCE LISTING, TABLE, OR INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

The invention being disclosed endeavors into the field of furniture and cabinetry as described by class A47B of the Cooperative Patent Classification.

The problem with a traditional dresser of drawers is that you are not able to see the entire contents of a given drawer at the same time due to the view of the contents being from the top-down, and you cannot view the contents of two consecutive drawers, or contents of all of the drawers, simultaneously; because when one drawer is slid open and you slide open the drawer beneath it, the contents of the lower drawer is obstructed in view by the upper drawer. Therefore, the user of the dresser of drawers is unable to accurately grasp the variety and entirety of the contents contained in the dresser without inconvenience.

The problem with traditional cabinetry is that the doors swing out horizontally away from the storage area. Because of this, it prevents the cabinet doors from being of considerable width. Also, because of the hinges traditionally used, any cabinet door that would swing vertically would not be able to remain open on it's own and would fall closed without the resistance of the person holding the cabinet door open.

The problem with a traditional trunk, like the traditional dresser of drawers, is that the contents can only be viewed from the top-down. And additionally, with the trunk, the storage compartments are not stackable because the lid to the storage compartment is the top panel of the structure.

The problem with traditional shelving is that there is nothing concealing the contents of the shelving from view.

BRIEF SUMMARY OF THE INVENTION

The invention being disclosed is a cabinet, dresser, shelving unit, storage container, or piece of storage furniture whose front door panel transitions between being down and concealing the contents of the storage compartment from view, and being up and revealing the storage compartment for view; by simultaneously rotating up and sliding inward, underneath the upper horizontal shelf panel of the storage compartment into a horizontal orientation to open, and simultaneously rotating downward and sliding back forward into a vertical orientation to close.

The incorporation of structural partitions with support tracks within the storage compartments and slotted front door panels allow for the storage compartments and associated front door panels to be of substantial width and stackable without the risk of the upper horizontal shelf panel of the storage compartment and front door panel deforming under load and over time. In a stacked configuration, this cabinet of drawers allows for the simultaneous viewing of all of the contents of all of the storage compartments simultaneously when all storage compartments are open.

BRIEF DESCRIPTION OF THE SEVERAL VIEWS OF THE DRAWING

FIG. 5 is to be viewed with the right-hand-side of the page rotated to become the top, and the stages have been ordered in numerical order via roman numerals.

DETAILED DESCRIPTION OF THE INVENTION

Figure 1:
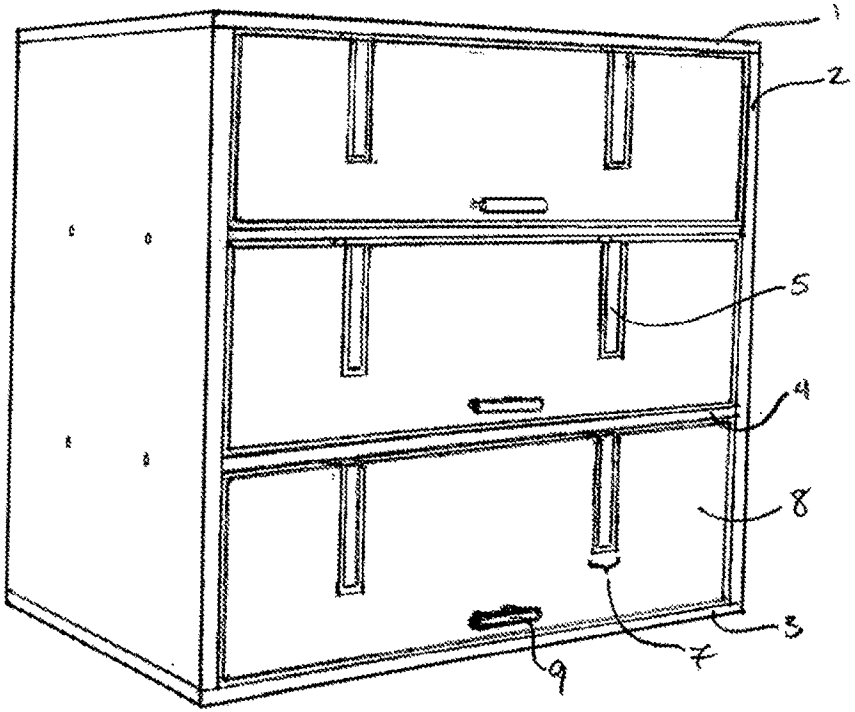
FIG. 1 depicts the invention in it's best mode contemplated by the inventor, containing all claims being submitted for approval. The dresser consists of three storage compartments, stacked one on top of another, with all storage compartments closed.

In the Detailed Drawings, numeral one (1) references the top shelf panel, also referred to as an upper horizontal shelf panel; numeral two (2) references a side panel, of which there are two; numeral three (3) references the bottom shelf; numeral four (4) references an interior shelf panel, also referred to as an upper horizontal shelf panel of which there are two; numeral five (5) references a structural partition, of which there are six; numeral six (6) references a notch cut out of a structural partition, also referred to as a notched cutout within the detailed description, of which there are six; numeral seven (7) references a slot in the front door panel, of which there are six, two per front door panel; numeral eight (8) references a front door panel, of which there are three; numeral nine (9) references a handle, of which there are three; numeral ten (10) references an upper recessed track, of which there are eighteen, three per side panel and two per vertical support panel; numeral eleven (11) references a rotational sliding pivot dowel, of which there are six; numeral twelve (12) references a lower recessed track, of which there are six; numeral thirteen (13) references a rotational sliding pivot wheel, of which there are six; numeral fourteen (14) references a rearward extension, of which there are six; numeral fifteen (15) references an alternate sliding rotational pivot dowel, of which there are twelve; numeral sixteen (16) references a cylindrical fulcrum, of which there are six; numeral seventeen (17) references a fixed closure magnet, of which there are six; numeral eighteen (18) references a variable closure magnet, of which there are six; numeral nineteen (19) references an upper plateau of a lower recessed track, also referred to as the upper plateau, of which there are six; numeral twenty (20) references a drop-off at the front end of an upper recessed track, of which there are eighteen; and numeral twenty-one (21) references a docking catch at the back end of an upper recessed track, also referred to as a docking catch, of which there are eighteen.

FIG. 1 depicts the invention with all front door panels (8) down and shut on all three storage compartments. The handles (9) are in a position and of an orientation to invite the operator of the invention to pull the handle towards themselves and upward, thus starting the mechanism in motion and most easily teaching the operator the movement of the invention without instruction.

Due to the storage compartments being stacked on top of one another and the considerable width of the composition as a whole, structural partitions (5) have been placed within each storage compartment to prevent the upper horizontal shelf panels (1)(4) of each storage compartment, as well as the substantially wide front door panels (8), from bowing and warping. Additionally, slots in the front door panels (7) and notched cut-outs in the structural partitions (6) have been integrated into each of these components in order to provide space for the structural partitions (5) to provide support for the front door panels (8) without disrupting or impeding the front door panel (8) from moving between the open and closed positions.

This support from the structural partitions (5) to the front door panels (8) is provided by alternate rotational sliding pivot dowels (15) that are secured to the front door panel (8) and rest and slide along the upper recessed tracks (10) placed on both sides of the structural partitions (5). These alternate rotational sliding pivot dowels (15) and upper recessed tracks (10) integrated into the structural partitions (5) can more easily be seen in the lower storage compartment of the exploded view provided in FIG. 6; in which special care has been taken to identify an alternate rotational sliding dowel (15) and upper recessed track (10) with which it would interact once fully assembled. These alternate rotational sliding pivot dowels (15) are labeled as "alternate" because, although they follow the same upper recessed track (10) path of operation as the rotational sliding pivot dowels (11), the method of securing the component to a front door panel (8) differs from the rotational sliding pivot dowels (11), and where the primary function of the rotational sliding pivot dowel (11) is to guide the top of the front door panel (8) to the rear of the composition; for the alternate rotational sliding pivot dowel (15), this function falls secondary to preventing the inner top four corners of a front door panel (8) created by the slots in the front door panels (7) from warping, falling out of alignment and compromising the function of the front door panel (8) as a whole.

Figure 2:
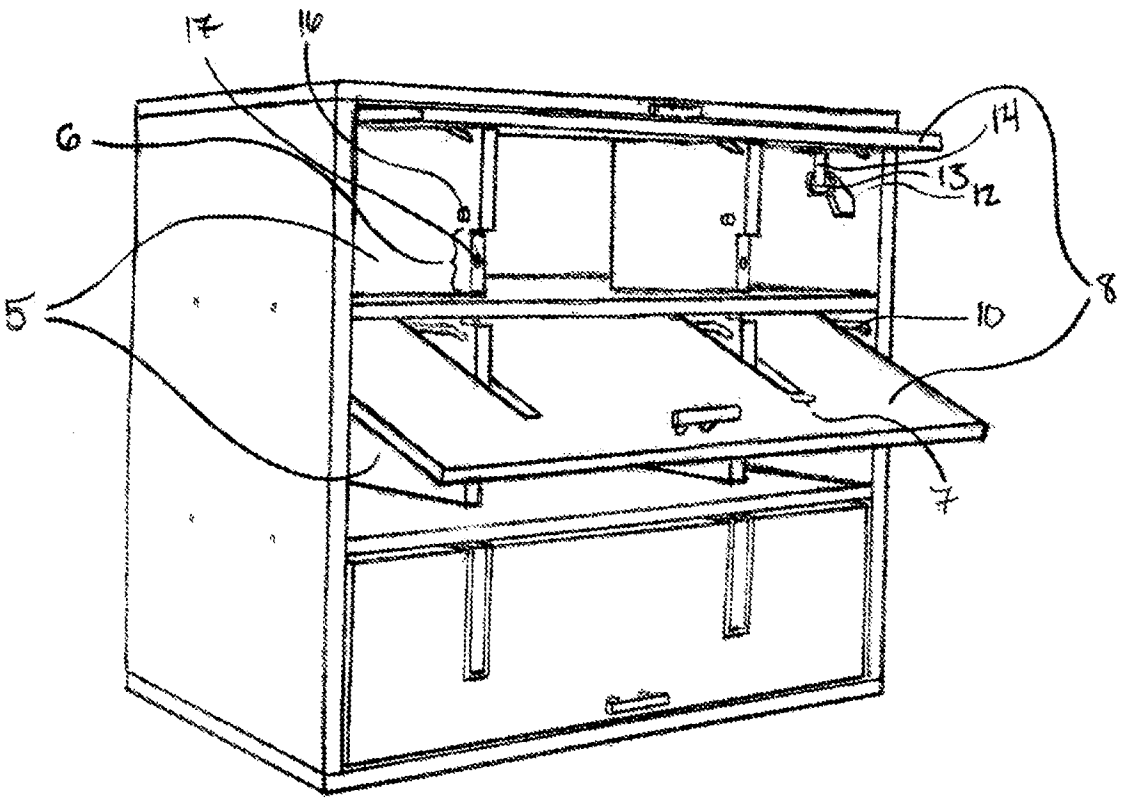
FIG. 2 depicts the same mode depicted in FIG. 1, with the top storage compartment fully open, the middle storage compartment half-way open, and the bottom storage compartment fully closed.

FIG. 2 illustrates the composition with the front door panels (8) at different stages of openness along their operating paths. From the bottom storage compartment-up, the drawing depicts the front door panel (8) in the fully closed position, half-way open position, and fully open position. This illustration is also the first time we get a glimpse at the inner workings of the invention; including the second rotational sliding pivot point known as the rotational sliding pivot wheel (13) extending backwards from the front door panel (8) through the use of a rearward extension (14), the lower recessed track (12) to which it (13) fits, the notched cut-outs of the structural partitions (6) located at the bottom of the structural partitions (5), and partial views of the upper recessed tracks (10) within both the side panels (2) and structural partitions (5). This drawing provides a fantastic look at how the slot in the front door panel (7) and notch cut out of the structural partition (6) work together to allow the front door panels (8) to operate as well as sit flush at the front of the composition when closed. This relationship between the slot in the front door panel (7) and notch cut out of the structural partition (6) has been identified and can be observed in the center storage compartment of the exploded view provided in FIG. 6, in which you can see the components on an individual basis and see how the notch cut out of the structural partition (6) at the bottom of the structural partition (5) provides space for the bottom of the front door panel (8), and how the slot in the front door panel (7) provides room for the upper-front of the structural partition (5).

Figure 3:
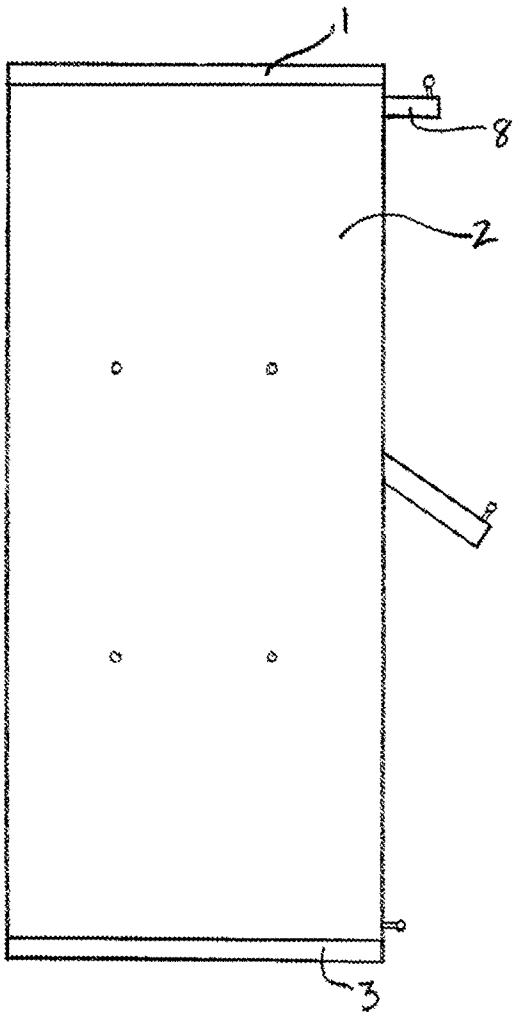
FIG. 3 depicts the same mode and sequence of drawers listed in FIG. 2, from a side profile view.
Figure 4:
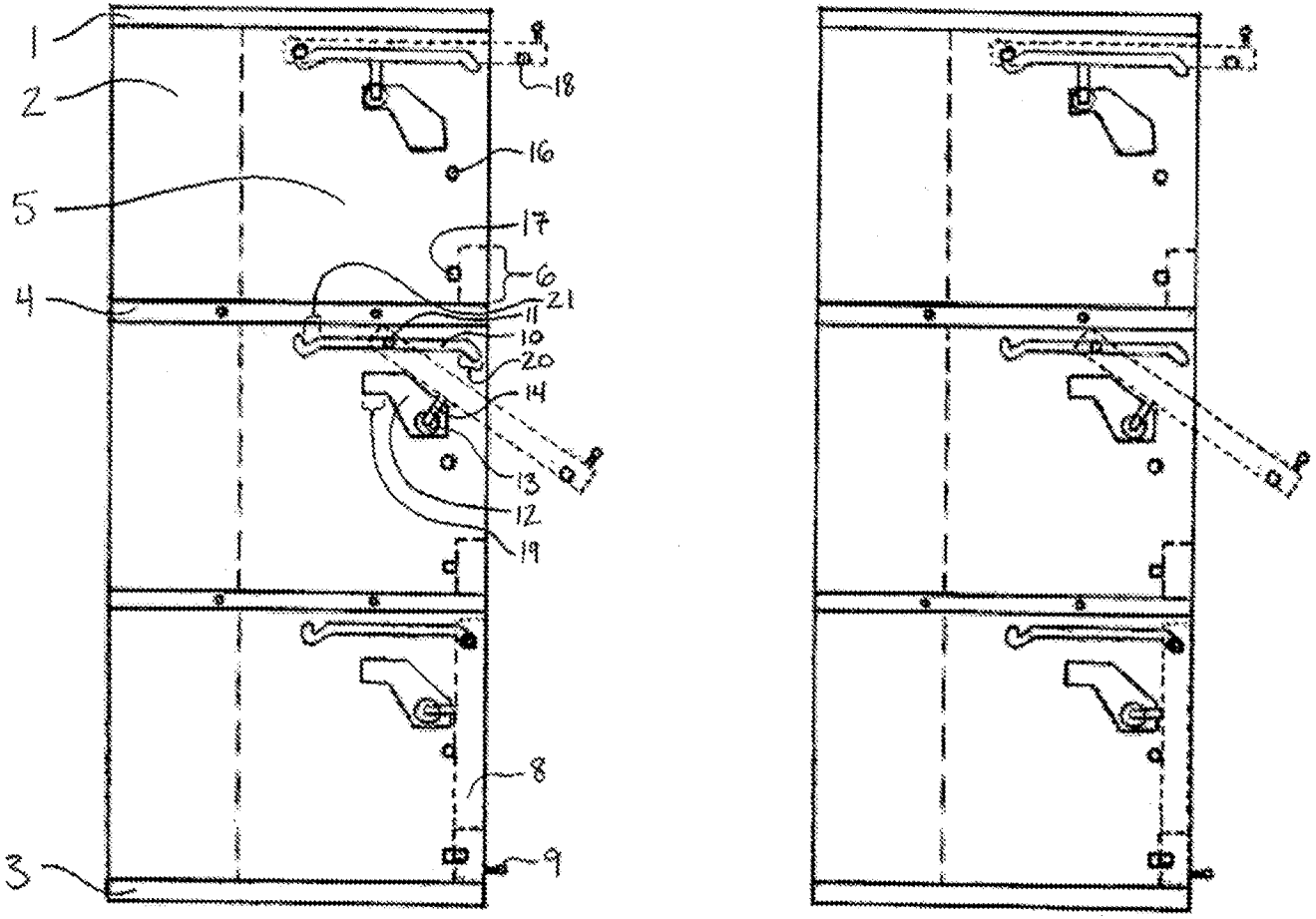
FIG. 4 depicts two identical compositions depicted in a cross-sectional view, with the same sequence of drawers and in the same mode profile view as depicted in FIG. 3; with the diagram on the left containing identifying marks, and the diagram on the right free of identifying marks for the purpose of clarity.

FIG. 3 stands as a visual transition between FIGS. 2 and 4. The front door panels (8) remain in the same configuration as FIG. 2, only the invention has been rotated to a side profile view.

FIG. 4 depicts the same profile view as FIG. 3, only the left side panel (2) and alternate rotational sliding pivot dowels (15) have been removed in order to minimize confusion, and the outlines of the structural partitions (5) and front door panels (8) have been changed to dotted outlines to communicate transparency for the purpose of providing a clearer view of the working components located on the structural partitions (5) and on the inside of the right side panel (2) at the far end of the composition. Two identical depictions of this perspective have been provided for the purpose of clarity; with the left diagram containing identifying marks, and the right diagram free of identifying marks.

Points of interest in FIG. 4 include: the integration of the drop-off (20) and docking catch (21) within the upper recessed track (10), the orientation of the upper (10) and lower (12) recessed tracks on the inside of the right side panel (2), the location of the rotational sliding pivot dowel (11) within the depth of the front door panel (8), the location of the cylindrical fulcrum (16) resting along the back of the front door panel (8) when the front door panel (8) is fully closed, and the fixed (17) and variable (18) magnetic closures; embedded within the structural partitions (5) at the rear of the notched cutout (6) and back face of the front door panel (8), respectively; with one of each of their (17)(18) faces exposed, and sitting flush with one-another when the front door panel (8) is fully-closed. The opposing magnetic fields of the the fixed (17) and variable (18) magnetic closures keep the front door panel (8) from moving from the fully-closed position when the operator of the invention is not opening the front door panel (8).

Figure 6:
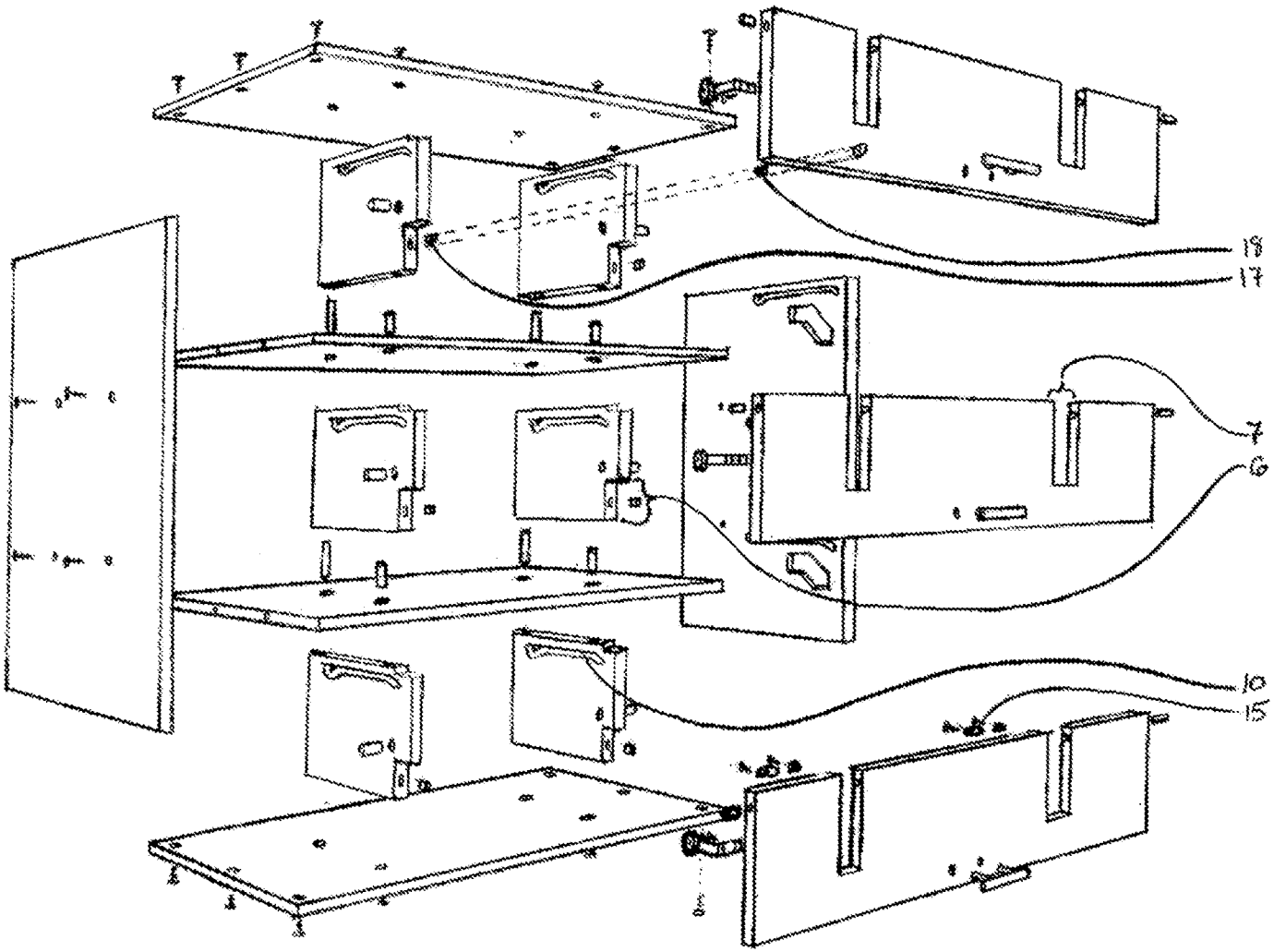
FIG. 6 depicts the same mode and sequence of drawers depicted in FIG. 1, in exploded view.

To better understand the correlation and relative location between the fixed (17) and variable (18) magnetic closures, special notation has been made in the upper storage compartment of the exploded view provided in FIG. 6; in which the variable magnetic closure (18) has been removed proportionally further rearward than the other intricate pieces of hardware in order to reveal it from behind the front door panel (8), and dotted lines have been placed between it (18), it's assembly location within the rear of the front door panel (8) and the fixed magnetic closure (17) with which it would interact once fully assembled.

In this layout, the rotational sliding pivot wheel (12) slides forward along the lower recessed track (12) before moving back up along that same lower recessed track (12) in the opposite direction and resting along the lower track's upper plateau (19). This back-and-forth movement, as well as the motion of the mechanism from open-to-closed, can more easily be observed in FIG. 5; where the three-high composition presented in FIG. 4 is divided further, into ten significant points along the operating path of a front door panel (8).

Figure 5:
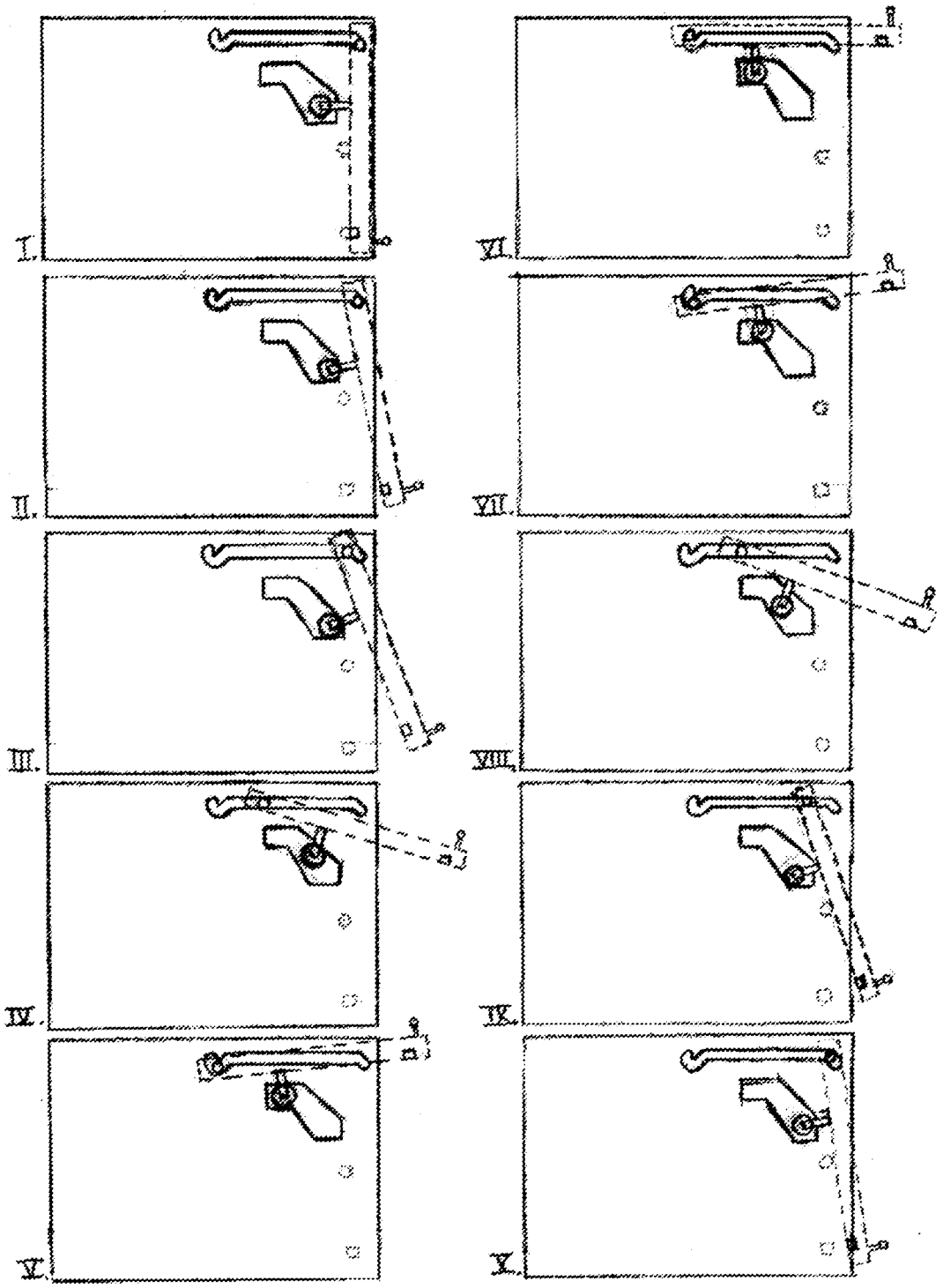
FIG. 5 depicts the same cross-section perspective of the mechanism depicted in FIG. 4; isolating each stage into a separate side panel and depicting more stages of the mechanism.

FIG. 5 is to be viewed with the right-hand side of the page rotated to become the top, starting with the top of the left column at roman numeral one (I) and proceeding in roman-numerical order: down the length of the left hand column, back up to the top of the right hand column and following down the length of the right hand column. The lay-out is constructed in such a way that when you finish at the bottom of the right hand column, at roman numeral ten (X), the operation of the invention continues back at the top of the left hand column at roman numeral one (I); in a loop.

The diagrams depicted in FIG. 5 differ from FIG. 4, in that the storage compartments have been isolated from one-another, into individual storage compartments through the removal of the top shelf panel (1), bottom shelf panel (3) and interior shelf panels (4); the dotted-outline of the structural partitions (5), including the notch cut out of structural partition (6), has been removed from the diagram for the sake of placing greater emphasis on the moving components on the inside of the right side panel (2) and front door panel (8); and the cylindrical fulcrum (16) and fixed magnetic closure (17) have been changed from solid-outlines to dotted-outlines in order to include them within the diagram and see how they interact with the front door panel (8) while still communicating their existence within the structural partitions (5) no longer depicted in the diagram. The front door panel (8) remains a dotted-outline, as in FIG. 4, for the purpose of fully revealing the operation of the components on the inside of the right side panel (2).

Starting from the top of the left hand column with roman numeral one (I), FIG. 5 displays the front door panel (8) in the fully closed position; the rotational sliding pivot dowel (11) is keeping the top of the front door panel (8) flush with the front of the composition by being secured within the drop-off (20) at the front end of the upper recessed track (10), the fixed (17) and variable (18) magnetic closures are keeping the bottom of the front door panel (8) flush with the front of the composition, and the cylindrical fulcrum (16) rests along the back side of the front door panel (8).

Roman numeral two (II) illustrates how the mechanism looks after the operator has pulled the handle (9) towards themselves. The rotational sliding pivot dowel (11) remains in the drop-off (20) at the front of the upper recessed track (10), but a slight angle has been created in the front door panel (8), the recessed rotational sliding pivot wheel (13) has been pulled towards the front and is now touching the end of the lower recessed track (12), and the variable magnetic closure (18) has been disengaged from the fixed magnetic closure (17).

Roman numeral three (III) illustrates how the mechanism looks after the operator has continued pulling rearward on the front handle (9), using the resistance of the lower recessed track (12) placed on the recessed rotational sliding pivot wheel (13) to propel the rotational sliding pivot dowel (11) up and out of the drop-off (20) at the front end of the upper recessed track (10).

Roman numeral four (IV) illustrates how the mechanism looks as the rotational sliding pivot dowel (11) and recessed rotational sliding pivot wheel (13) continue sliding along the upper (10) and lower (12) recessed tracks towards the rear of the composition; simultaneously and consecutively.

Roman numeral five (V) illustrates how the mechanism looks after the rotational sliding pivot dowel (11) has come into contact with the docking catch (21) at the back of the upper recessed track (10). Because the rotational sliding pivot dowel (11) has to be maneuvered under and around the docking catch (21), the operator of the invention has to rotate the front door panel (8) beyond ninety degrees while pushing forward on the handle (9). The recessed rotational sliding pivot wheel coming in contact with the top of the lower recessed track (12) helps the rotational sliding pivot dowel (11) achieve it's downward motion by acting as a fulcrum.

Roman numeral six (VI) depicts the mechanism after the rotational sliding pivot dowel (11) has surpassed the docking catch (21). The rotational sliding pivot dowel (11) is now behind the docking catch (21) and is restricted from sliding forward, so the operator of the invention is free to release the handle (9) and the front door panel (8) will remain open. The recessed rotational sliding pivot wheel (13) is now resting on the upper plateau (19) of the lower recessed track (12) and is propping up the front door panel (8) into a fully-horizontal position. This is both aesthetically pleasing and allows the operator the ability to freely see and access the contents contained within the storage compartment.

Roman numeral seven (VII) depicts the mechanism after the operator has re-grasped a hold of the front handle (9) and begun closing the front door panel (8) by lifting the handle (9) and front door panel (8) back up, past ninety degrees, and begun pulling the handle (9) towards themselves. The recessed rotational sliding pivot wheel (13) is back up off the upper plateau (19) of the lower recessed track (12) and in contact with the upper border of the lower recessed track (12) in order to act as a fulcrum, and the rotational sliding pivot dowel (11) is below the docking catch (21) on it's way around and back towards the front of the upper recessed track (10).

Roman numeral eight (VIII) depicts the rotational sliding pivot dowel (11) after it is past the docking catch (21) and the recessed rotational pivot wheel (13) after it is beyond the front edge of the lower recessed track's (12) upper plateau (19). At this time, although the operator is still grasping the handle (9), gravity is providing the majority of the work sliding the front door panel (8) back down towards it's fully-closed position, and as such, the recessed rotational sliding pivot wheel (13) will be rolling along the bottom edge of the recessed lower track (12) towards the bottom.

In roman numeral nine (IX), we see the back of the front door panel (8) coming in contact with the cylindrical fulcrum (16) for the first time; as the rotational sliding pivot wheel (13) is still in contact with and rolling down the lower recessed track (12).

In roman numeral ten (X), we see the mechanism after the operator has begun applying forward, and slightly downward, force on the front handle (9). This forward force uses the resistance of the cylindrical fulcrum (16) on the back of the front door panel (8) to lift the rotational sliding pivot wheel (13) off of the lower recessed track (12), and propel the rotational sliding pivot dowel (11) forward towards the drop-off (20) at the front end of the upper recessed track (10).

To see the composition fully closed, please revert back to roman numeral one (I).

The invention claimed is:

1. A storage compartment with a door suspended by horizontally-mounted rotational sliding pivots on either side, that support the weight of the door and guide the door from a vertical position at the front of the storage compartment when closed, up and into the storage compartment, under an upper panel of the storage compartment, and into a horizontal position when open via interaction with tracks in side panels on either side of the storage compartment; a vertical and linear slot in the door, beginning at the top of the door and terminating short of the bottom of the door in order to allow the door and parts secured to the door to operate, move and rotate as one during operation; a horizontally-mounted rotational sliding pivot secured to the door and extending into the slot to support the weight of the door between suspension points at either end of the door and help guide the door during operation; and a structural partition with a notch cut-out and a track along the side, to, respectively, support the weight of the upper panel of the storage compartment while accommodating the portion of the door below the slot that terminates mid-panel and support and guide the horizontally-mounted rotational sliding pivot secured to the door.

* * * * *